US010492585B2

(12) United States Patent
Weatherly

(10) Patent No.: US 10,492,585 B2
(45) Date of Patent: Dec. 3, 2019

(54) HAIR DRYER

(75) Inventor: Robert Alexander Weatherly, Cambridgeshire (GB)

(73) Assignee: Jemella Limited, Leeds (GB)

( * ) Notice: Subject to any disclaimer, the term of this patent is extended or adjusted under 35 U.S.C. 154(b) by 928 days.

(21) Appl. No.: 13/990,516

(22) PCT Filed: Dec. 8, 2011

(86) PCT No.: PCT/GB2011/052425

§ 371 (c)(1), (2), (4) Date: Aug. 20, 2013

(87) PCT Pub. No.: WO2012/076885

PCT Pub. Date: Jun. 14, 2012

(65) Prior Publication Data

US 2014/0290087 A1 Oct. 2, 2014

(30) Foreign Application Priority Data

Dec. 8, 2010 (GB) ..... 1020847.8

(51) Int. Cl.
*A45D 20/00* (2006.01)
*A45D 20/12* (2006.01)

(52) U.S. Cl.
CPC ..... *A45D 20/00* (2013.01); *A45D 20/12* (2013.01)

(58) Field of Classification Search
CPC ..... A45D 20/12; A45D 20/00; A45D 20/08; A45D 20/122
USPC ..... 34/98, 96
See application file for complete search history.

(56) References Cited

U.S. PATENT DOCUMENTS 3,943,329 A 3/1976 Hlavac
5,525,277 A * 6/1996 Joseph ..... B29C 47/0026 264/40.6
6,011,903 A 1/2000 Nosenchuck
6,792,692 B1 * 9/2004 Takizawa ..... A45D 20/12 34/283
2003/0079366 A1 5/2003 Chang
2004/0163274 A1 8/2004 Andrew et al.
2005/0229422 A1 10/2005 Mattinger et al.
(Continued)

FOREIGN PATENT DOCUMENTS

CN 2423786 Y 3/2001
CN 1477937 A 2/2004
CN 1954737 A 5/2007
(Continued)

OTHER PUBLICATIONS

British Search Reports for corresponding application No. GB1020847.8; Search dated Mar. 4, 2011; Mar. 7, 2011; Mar. 14, 2011; Feb. 18, 2011; Feb. 23, 2011;.
(Continued)

*Primary Examiner* — Kenneth Rinehart
*Assistant Examiner* — Bao D Nguyen
(74) *Attorney, Agent, or Firm* — Schwegman Lundberg & Woessner, P.A.

(57) ABSTRACT

A hair dryer comprising: a housing defining a first air flow channel and a second air flow channel, whereby the first air flow channel at least substantially circumscribes the second air flow channel; an air flow regulation means to regulate the flow of air along the first air flow channel and/or the second air flow channel.

20 Claims, 11 Drawing Sheets

(56) References Cited

U.S. PATENT DOCUMENTS

2006/0098962 A1 5/2006 Ceva

FOREIGN PATENT DOCUMENTS

| | | | | | |
|---|---|---|---|---|---|
| CN | 202218686 | U | | 5/2012 | |
| DE | 3115569 | A1 | | 12/1982 | |
| DE | 9001199 | U1 | | 7/1990 | |
| EP | 1371302 | A1 | | 12/2003 | |
| EP | 1415566 | A2 | | 5/2004 | |
| EP | 1433401 | A2 | | 6/2004 | |
| FR | 1387334 | | | 12/1963 | |
| FR | 1387334 | A | * | 1/1965 | ..... A45D 20/10 |
| GB | 2016051 | A | | 9/1979 | |
| GB | 2163574 | A | | 2/1986 | |
| GB | 2318544 | A | | 4/1998 | |
| GB | 2398239 | A | | 8/2004 | |
| GB | 2472240 | A | | 2/2011 | |
| JP | 2000201723 | A | | 7/2000 | |
| JP | 2004113402 | A | | 4/2004 | |
| JP | 2005185864 | A | | 7/2005 | |
| JP | 2006051181 | A | | 2/2006 | |
| JP | 2006130181 | A | | 5/2006 | |
| JP | 2008178549 | A | | 8/2008 | |
| JP | 2012019865 | A | | 2/2012 | |
| KR | 1020090119155 | A | | 11/2009 | |
| NL | 8701144 | A | | 12/1988 | |
| WO | 9423611 | A1 | | 10/1994 | |
| WO | 2007043732 | A1 | | 4/2007 | |
| WO | 2009097321 | A1 | | 8/2009 | |
| WO | 2010045698 | A1 | | 4/2010 | |
| WO | WO-2012076885 | A2 | | 6/2012 | |
| WO | WO-2012076885 | A3 | | 6/2012 | |

OTHER PUBLICATIONS

International Search Report for corresponding application PCT/GB2011/052425 filed Dec. 8, 2011; dated Jun. 1, 2012.

Written Opinion for corresponding application PCT/GB2011/052425 filed Dec. 8, 2011; dated Jun. 1, 2012.

AU Patent Examination Report No. 1, for corresponding application AU2011340266; Examination Request dated Nov. 28, 2014.

Japanese Office Action for corresponding application 201180059397.6; Report dated Apr. 1, 2015.

"European Application Serial No. 11794848.9, Communication Pursuant to Article 94(3) EPC dated Jun. 28, 2016", 5 pgs.

"European Application Serial No. 11794848.9, Response filed Jan. 24, 2014 to Communication pursuant to Rules 161(1) and 162 EPC dated Jul. 16, 2013", 12 pgs.

"European Application Serial No. 11794848.9, Response filed Oct. 25, 2016 to Communication Pursuant to Article 94(3) EPC dated Jun. 28, 2016", 10 pgs.

"International Application Serial No. PCT/GB2011/052425, International Preliminary Report on Patentability dated Jun. 20, 2013", 7 pgs.

"United Kingdom Application Serial No. 1720073.4, Combined Search and Examination Report dated Jan. 30, 2018", 7 pgs.

Chinese Office Action for corresponding application 201180059397.6; Report dated Apr. 1, 2015.

"Chinese Application Serial No. 201810072096.0, Office Action dated Mar. 19, 2019", (Mar. 19, 2019), 8 pgs.

* cited by examiner

HAIR DRYER

FIELD OF INVENTION

The invention relates to hair dryers.

BACKGROUND TO THE INVENTION

A hair dryer provides a stream of air. The stream of air may be used to remove moisture from hair and/or style hair.

A hair dryer typically comprises a main body comprising an air inlet, an air outlet, a fan and a heating means. The fan draws external air into the main body via the air inlet and blows out a stream of air through the air outlet. The heating means are arranged to heat the air flow so as to provide a hot stream of air.

A hair dryer may comprise a nozzle to control the stream of air from the air outlet. The nozzle may be releasably mounted at the air outlet of the main body.

A hand-held hair dryer comprises a handle. The handle is typically located on the underside of the main body and extends substantially perpendicularly to the longitudinal axis of the main body.

Background prior art can be found in: FR1387334, EP1371302 A1, W094/23611, JP2004-113402 and JP2006-130181A.

SUMMARY OF THE INVENTION

The invention seeks to provide a new or otherwise improved hair dryer.

According to an aspect of the invention, there is provided a hair dryer comprising: a housing defining a first air flow channel and a second air flow channel, whereby the first air flow channel at least substantially circumscribes the second air flow channel; an air flow regulation means to regulate the flow of air along the first air flow channel and/or the second air flow channel.

The air flow regulation means preferably comprise a member movable between a first position and a second position, whereby in the first position the member is arranged to at least substantially close an inlet aperture of the first air flow channel and in the second position the member is arranged to at least minimise an inlet aperture of the second air flow channel.

Typically, the hair dryer comprises a housing having an air inlet at one end of the housing and an air outlet at the opposed end of the housing. A fan unit and its associated motor unit are mounted within the housing for drawing air through the air inlet, through the housing and out the air outlet. A heating element is mounted downstream from the fan unit for warming air which passes over the heating element. A nozzle is often fitted to the housing at the air inlet to direct air flow.

The first air flow channel may be defined between an inner surface of the housing and an outer surface of the second air flow channel. A heater may be mounted in the second air flow channel and the first air flow channel may be insulated from the heater. The air flow regulation means may be configured to instantaneously redirect the flow of air from the second air flow channel to the first air flow channel whereby a cold shot of air is provided.

Such "cool shots" of air allow a user to "fix" a hairstyle. Typically, "fixing" a hairstyle created with the heat from an existing hair dryer takes around 30 seconds per section of hair and needs to be done quickly after heating. With existing hair dryers, switching off the power to the heating means may provide a "cool shot". However, the air takes a long time to cool. The use of air flow regulation means as described above instantaneously redirects the flow of air and therefore improves the function of the hair dryer as a means to "fix" a hairstyle. This is because it is capable of switching from hot to cold air instantly.

The first air flow channel preferably circumscribes the second air flow channel along its length. In this way, the heated parts are insulated from a user. Moreover, the "cool shot" is delivered direct to a user's hair. The first air flow channel may extend at least substantially along the length of the housing and may further extend to a nozzle region of the housing. The first air flow channel may extend beyond the second air flow channel at the air inlet. Alternatively, the first air flow channel and second air flow channel may terminate together. The moveable member may be activated by user operated control means, e.g. a button on the handle of the hair dryer.

The air flow regulation means may comprise a moveable member connected to actuation means whereby movement of said actuation means moves said moveable member. The actuation means may slide along a shaft connected to a motor which draws air into the hair dryer. The actuation means may be in the form of a piezo motor, solenoid actuator, mechanism taking movement from activating the "cool shot" button on the handle, a magnetic clutch driven off the main motor, a wax actuator or a shape-memory alloy.

In the first position the moveable member may taper downstream and in the second position the moveable member may taper upstream. In other words, the moveable member may have a greater cross-section towards the air inlet of the hair dryer in the first position and a greater cross-section towards the air outlet of the hair dryer in the second position. Since the first air flow channel substantially circumscribes the second air flow channel, this is a simple arrangement to close the first air flow channel in the first position and to at least substantially close the second air flow channel in the second position.

The moveable member may be formed from a plurality of panels. This may provide greater flexibility of movement and also provide for ease of manufacture.

The air flow regulation means may further comprise at least one fixed element which co-operates with the moveable member to close at least one of said first and said second air flow channels. By co-operate it is meant that the moveable member and said at least one fixed element are in contact or at least proximate, whereby closure is achieved.

The at least one fixed element may comprise an outer fixed element which protrudes from an outer surface of the housing and co-operates with the moveable member to close said first air flow channel in said first position. The outer fixed element may be angled downstream or may be angled upstream. The outer fixed element may substantially circumscribe the moveable member and/or second air flow channel. The outer fixed element may generally be a hollow frusto conical shape.

The at least one fixed element may comprise a central fixed element which is concentrically mounted within the housing and which co-operates with the moveable member to close said second air flow channel in said second position. The moveable member and the central fixed element may be in the form of perforate plates each having offset perforations whereby when the moveable member and the central fixed element are in contact, the second air flow channel is closed. Alternatively, the moveable member may be generally cylindrical inwardly projecting flange which contacts the central fixed element in the second position.

There may be both a central fixed element and an outer fixed element.

The moveable member and at least one fixed member may be made from a ferro-magnetic material. The regulation means may comprise actuation means configured to change a polarity of at least one of said moveable member and said at least one fixed member to move said moveable member relative to said at least one fixed member.

We also describe several other hairdryer arrangements which may be used alone or in conjunction with the first aspect of the invention above.

A first arrangement relates to a hair dryer comprising: a housing defining a first air flow channel and a second air flow channel, whereby the first air flow channel is configured to at least substantially circumscribe the second air flow channel and the first air flow channel is configured to form a venturi effect for driving air along the first air flow channel from a first air inlet to a first air outlet, a fan for driving air along the second air flow channel from a second air inlet to second air outlet; and a heating means for heating the air flow in the second air flow channel;

Such an arrangement provides cooling of the hair dryer, particularly the nozzle.

The first air flow channel may comprise a third air inlet and the fan may be configured to drive air along the first air flow channel via the third air inlet.

A second arrangement relates to a hair dryer comprising a heating means comprising multiple heating elements supported by a support means. The support means comprises a front region whereby air is separated into multiple air flow streams and a rear region configured to combine the multiple air flow streams so as to form an air flow stream having a substantially uniform temperature profile.

Such an arrangement thus provides a reduction in temperature change across the air stream.

The support means may comprise multiple fins. Each fin may have a front portion and a rear portion. The fins may be configured such that the front portions of the fins define multiple air flow channels and the rear portions of the fins define the rear region.

A third arrangement relates to a hair dryer comprising: a fan for blowing air through an air outlet; and control means for automatically controlling the operation of the fan so as to at least substantially maintain a constant air flow volume during use.

Such an arrangement thus provides an adjustment of air flow volume.

The control means may control the rotational speed of the fan so as to at least substantially maintain a constant air flow volume.

If the hair dryer is operable at one of several pre-selected air flow volumes, the control means may automatically control the rotational speed of the fan so as to at least substantially maintain the pre-selected air flow volume.

A fourth arrangement relates to a hair dryer comprising: a housing defining a first air flow channel and a second air flow channel, whereby the first air flow channel at least substantially circumscribes the second air flow channel; a fan for driving air along the air flow channels; and a heating means for heating the air flow in the second air flow channel.

Such an arrangement provides cooling of the hair dryer.

The first air flow channel may extend at least substantially along the length of a nozzle region of the housing.

A fifth arrangement relates to a hair dryer comprising: a stator to generate a smooth flow of air; and a heating means to heat the flow of air; whereby the stator and heating means are arranged in a substantially same location in a housing of the hair dryer.

Such an arrangement thus provides combined heating and flow control.

The stator and heating means may be integrally formed.

A sixth arrangement relates to a hair dryer comprising: a rear wall having a first rear air inlet; a baffle member spaced from the rear wall so as to define a second rear air inlet between the baffle member and the rear wall; wherein, in use, air is drawn into the hair dryer through the second rear air inlet and first rear air inlet.

Such an arrangement provides acoustic attenuation.

The baffle member may be generally planar and located substantially perpendicular to a longitudinal axis of the hair dryer such that air enters the second air inlet at an angle to the longitudinal axis. The angle may be substantially 90 degrees. The baffle member may comprise acoustic absorbing material.

BRIEF DESCRIPTION OF THE DRAWINGS

The invention is illustrated by way of example in the following figures in which.

DETAILED DESCRIPTION OF THE DRAWINGS

Figure 1A:
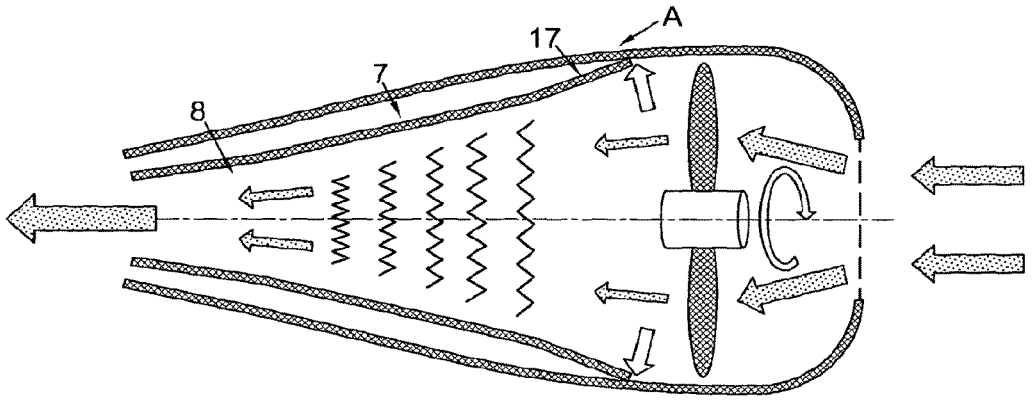
FIGS. 1*a* to 1*h* are cross-sections of a hairdryer incorporating moving components to regulate airflow.

Various features are shown in the drawings. These features are applicable to all aspects of the invention and may be used in any combination.

In each variation, the hair dryer comprises a housing having an air inlet at one end of the housing and an air outlet at the opposed end of the housing. A fan unit and its associated motor unit are mounted within the housing for drawing air through the air inlet, through the housing and out the air outlet. A heating element is mounted downstream from the fan unit for warming air which passes over the heating element. By considering the direction of air flow, the rear of the heating element may be considered to be the end of the heating element closest to the air outlet. As with conventional hair dryers, the hair dryer also comprises a handle for a user to hold the hairdryer.

Regulation of Air Flow Along an Air Flow Channel

We describe how to provide air flow regulation means to control the flow of air along one or more air flow channels of the hair dryer.

The air flow regulation means may comprise a movable member to control the geometry of an inlet aperture of the air flow channel. The movable member may be movable so as to open and close the inlet aperture of the air flow channel. The movable member may be movable to an intermediate position whereby the geometry of the inlet aperture is reduced so as to impede (restrict) the flow of air into the air flow channel.

Figure 1B:
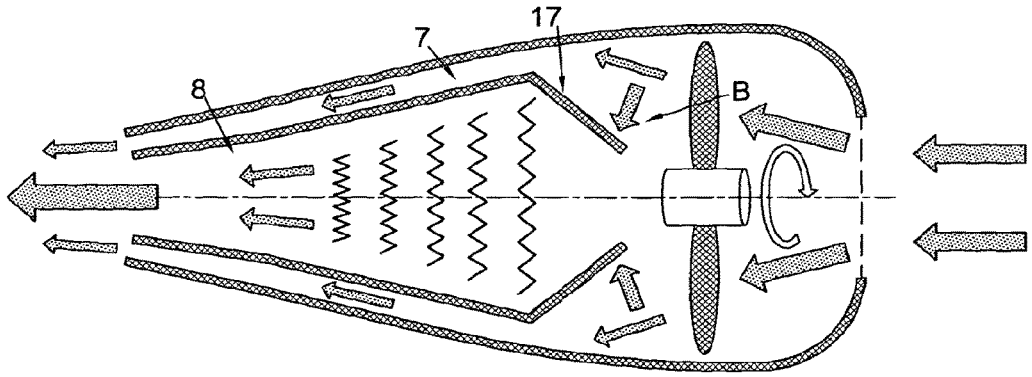

FIGS. 1*a* and 1*b* depict an embodiment where the hair dryer comprises an outer air flow channel (7), an inner air flow channel (8) and a movable member (17) to control the flow of air along the outer air flow channel and the inner air flow channel. The movable member is movable between a first position and second position. The inner air flow channel (8) is circumscribed by, i.e. mounted within, the outer air flow channel (7). The outer air flow channel (7) is defined between the inner wall of the housing and the outer wall of the inner air flow channel (8). A heater is mounted within the inner air flow channel (8) and is insulated from the outer air flow channel (8) by the wall of the inner air flow channel (8).

In the first position (A) the inlet of the outer air flow channel is closed and the inlet of the inner air flow channel is open (see FIG. 1*a*) to provide a passage connecting the air inlet and the air outlet. As shown by the arrows, air is drawn by the fan unit through the air inlet into the interior of the hair dryer. The heating element is mounted within the inner air flow channel and thus the air is warmed. The warm air then passes out through the air outlet.

In the second position (B), the inlet of the outer air flow channel is open and the inlet of the inner air flow channel is at least restricted (see FIG. 1*b*). As shown by the arrows, air is drawn by the fan unit through the air inlet into the interior of the hair dryer. The majority of the air flows down the outer air flow channel bypassing the heating element mounted within the inner air flow channel. Thus, a simple mechanical air flow regulator redirects air away from the heater (ranging from 0-100%), enabling the air temperature exiting the air outlet to change from hot to ambient temperature almost instantly. Thus, when the moveable member is located in the second position, the hair dryer is configured to provide a "cool shot" of air. Such "cool shots" are used for "fixing" a hair style.

Using a moveable member or air flow regulation device to control the flow of air through the inner and outer channels allows the air temperature exiting the nozzle to change from hot to ambient temperature almost instantly. In addition, regulating the balance of air flow between each channel can be used to adjust the air flow temperature. For example, the moveable member may be arranged in an intermediate position whereby the inlet of the outer air flow channel and the inlet of the inner air flow channel are open.

In both FIGS. 1*a* and 1*b*, at the air outlet, the inner air flow channel terminates before the outer air flow channel. In this way, no heated component extends beyond the cooler component, thus minimising injury to a user.

The moveable member may be activated using any suitable control means such as a magnetic clutch or breaking system. The mechanism may work by force applied by the user or by force applied by the motor system which drives the fan unit.

Figure 1C:
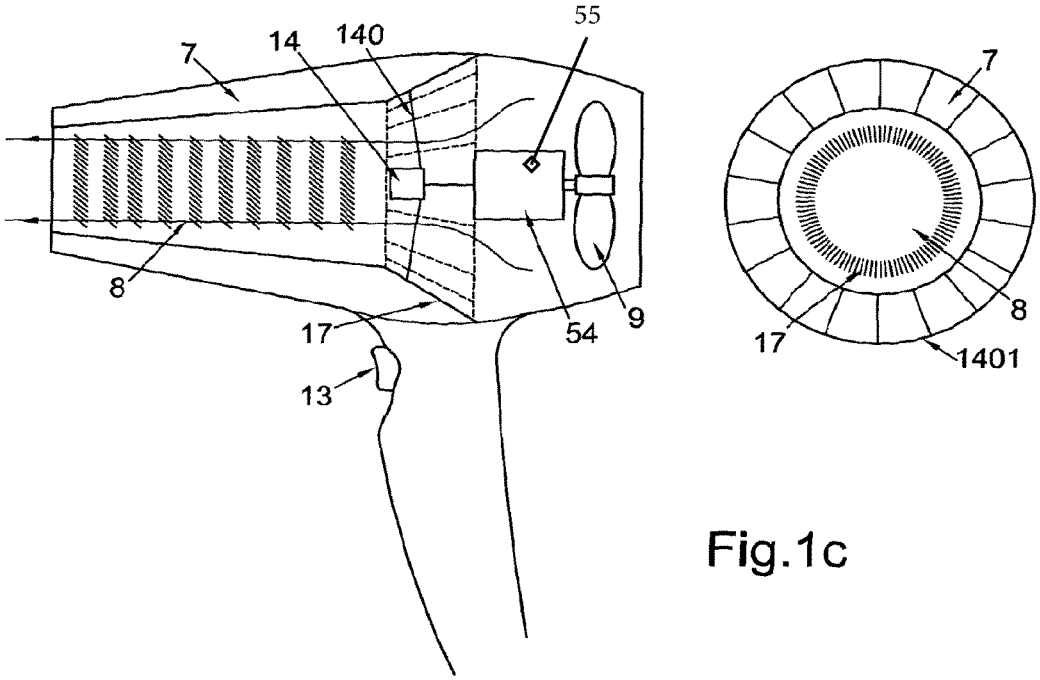
Figure 1D:
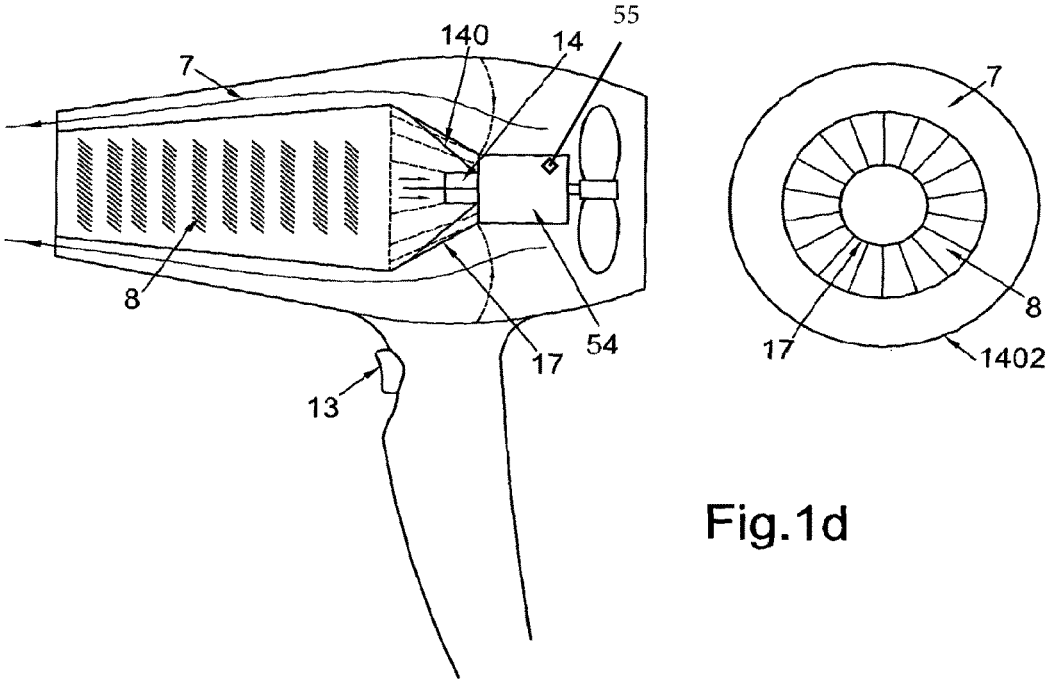

The hairdryer shown in FIGS. 1*c* and 1*d* is generally similar to that shown in FIGS. 1*a* and 1*b* and thus the elements in common have the same numbering. In the hair dryer depicted in FIGS. 1*c* and 1*d*, the hair dryer comprises a housing defining an outer air flow channel (7), an inner air flow channel (8), a moveable member (17) to control the flow of air along the outer air flow channel and the inner air flow channel, a "cool shot" button (13) and actuation means (14). The actuation means (14) is slidably located on a fixed shaft extending concentrically from the main motor (54). In this embodiment, the actuation means is in the form of a piezo motor but may be formed from any one of the following devices to provide the actuation movement: solenoid actuator, mechanism taking movement from activating the "cool shot" button (13) on the handle, a magnetic clutch driven off the main motor, a wax actuator or a shape-memory alloy. The actuation means (14) is connected to the moveable member (17) via a plurality of regulation members (140) which are generally rod-like struts. The actuation means, regulation member and moveable member co-operate to control the opening and closing of the air flow channels and thus form the air flow regulation means. In variants, the actuator may be fixed and the shaft may move around the actuator. The shaft then moves relative to the actuator to control the moveable member and provide the air flow regulation means.

FIG. 1*c* shows a first position in which the inlet into the outer air flow channel (7) is closed and thus, air is drawn in by the fan (9) through the inner air flow channel (8). The air is heated by a heater located within the inner air flow channel so as to provide a hot stream of air. FIG. 1*c* also shows a schematic end cross-section (1401) without the motor and actuation means. The annular cross-section of the outer air flow channel (7) is closed by the moveable member (17). As shown, the moveable member (17) is formed from a plurality of panels. The moveable member (17) may be made from a combination of flexible materials such as, but not limited to, rubber, and supported by panels or a ridged endoskeleton structure made of plastics or metals. The moveable member (17) forms a hollow frusto-conical shape having its narrower end at the downstream end, i.e. closer to the air outlet. The moveable member is concentrically mounted within the housing, e.g. with respect to the motor, so that the hollow portion is aligned with the inner air channel, so that air may flow through the inner air channel.

The moveable member (17) is held in this open, expanded state by the plurality of regulation members (140) which pushes the moveable member (17) so that the moveable member is in contact with the inner wall of the housing, thereby closing the outer air flow channel and preventing air flow through it. The open, expanded state is achieved when the actuation means is located on the end of the fixed shaft furthest away from the main motor (54). In this position, the actuation means pushes the regulation device into the expanded state.

If a user wishes a "cool shot", they depress the "cool shot" button (13) which activates the actuation means and hence moves the moveable member. As shown in FIG. 1*d*, the moveable member is positioned to direct air only down the outer air flow channel (7), thereby bypassing the heater and exiting the hair dryer as a "cool shot" of air. Activation of the actuation means (14) causes it to slide along the fixed shaft towards the motor (54). This causes the regulation members (140) to be drawn along with the actuation means. The movement of the regulation members (140) reduces the force on the moveable member (17), which repositions the moveable member such that access to the outer air channel is possible but access to the inner air channel is not. The movement of the regulation members (140) draws the moveable member into a collapsed or closed state. In other words, the moveable member can expand and collapse in the same way as a conventional umbrella opens and closes.

FIG. 1*d* also shows a schematic end cross-section (1402) without the motor and actuation means. The annular cross-section of the inner air flow channel (8) is closed by the moveable member (17). In this arrangement, the moveable member (17) also forms a hollow frusto-conical shape tapering upstream, e.g. having its narrower end at the upstream end, i.e. closer to the air inlet. The moveable member is concentrically mounted within the housing, e.g. with respect to the motor, so that its hollow portion is aligned with the motor, so that air may not flow through the inner air channel.

Figure 1E:
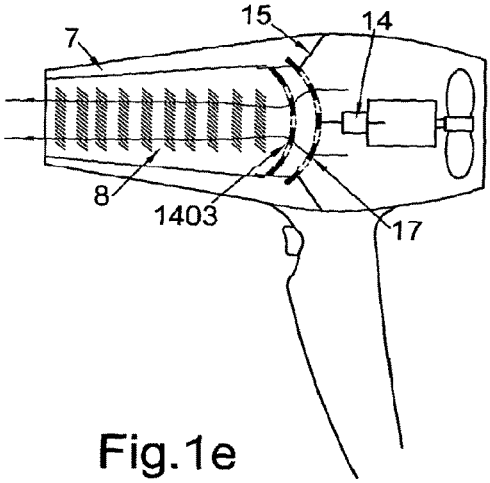
Figure 1F:
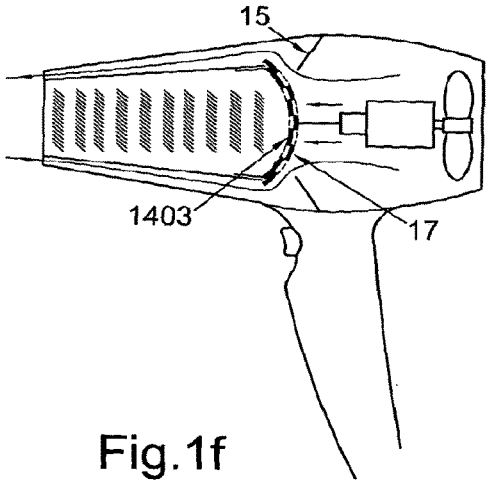

The hairdryer shown in FIGS. 1*e* and 1*f* is generally similar to that shown in FIGS. 1*c* to 1*d*. As above the actuation means (14) is slidably located on a fixed shaft extending concentrically from the main motor (54). In this embodiment, the air flow regulation means comprises a moveable member (17), a central fixed element (1403) and an outer fixed element (15). In this arrangement, the actuation means (14) is connected to the moveable member (17) which is in the form of a convex perforate panel (with the perforations schematically illustrated by the dashed lines). The moveable member has an upstanding flange which extends around its circumference. The central fixed element is also a perforate convex panel (1403) which covers the inlet to the inner air channel (8). The outer fixed element is a protruding element (15) projecting at an angle from the inner surface of the housing to at least partially cover the inlet to the outer air channel (7). The protruding element may be a single piece or formed from a plurality of elements and is angled (or tapers) towards the air inlet of the hair dryer.

The actuation means moves the moveable member (17) between a first position in which the moveable member (17) is in contact with the protruding element (15) (FIG. 1*e*), and a second position in which the moveable member (17) is in contact with the second perforate panel (1403) (FIG. 1*f*). In the configuration shown in FIG. 1*e*, air is prevented from flowing down the outer air channel by the combination of the flange on the moveable member and the protruding element (15) which co-operate to close the outer air channel. Air is blown by the fan through the perforations of the moveable member, on through the perforations in the second perforate panel and into the inner air channel. The air exits the hair dryer as hot air.

In FIG. 1*f*, the two perforate panels are in contact and the flange on the moveable member nests within the inner air flow channel, thus allowing air blown by the fan to flow through the outer air channel. This air bypasses the heating elements and exits as a "cool shot" of air. Air is prevented from flowing through the inner air channel by the offsetting of the perforations of the two panels. When the two panels are in contact, perforated sections of the moveable member align with unperforated sections of the other panel and vice versa, thereby forming a solid impenetrable barrier to the inner channel.

Figure 1G:
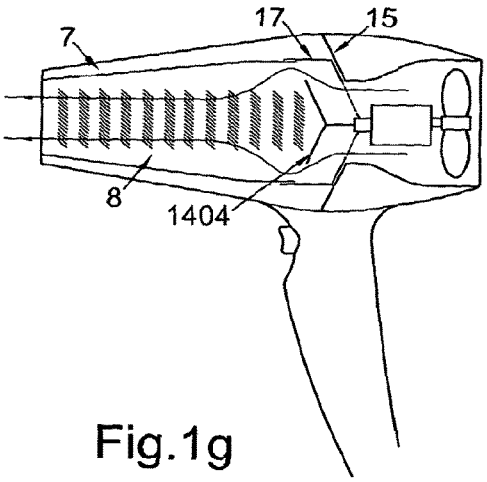
Figure 1H:
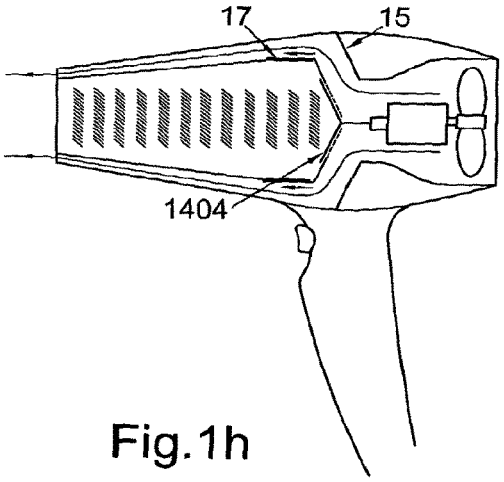

The embodiment shown in FIGS. 1*g* and 1*h* is generally similar to that shown in FIGS. 1*e* and 1*f*. In this embodiment, the air flow regulation means comprises a moveable member (17), a central fixed element (1404) and an outer fixed element (15). The moveable member is generally cylindrical with a flange projecting inwards around the upstream circumference, and comprises a perforate section (with the perforations schematically illustrated by the dashed lines). The central fixed element (1404) is in the form of a shallow circular cone having its apex attached to the shaft on which the actuation means (14) is mounted. The other fixed element (15) protrudes at an angle to the inner wall of the housing. The protruding element (15) tapers away from the air outlet, i.e. is angled back towards the air inlet. Accordingly, the protruding element (15) connects to a generally cup shaped cover for the fan which prevents air becoming trapped upstream of the protruding element. The moveable member and central fixed element may be constructed from ferromagnetic other magnetic materials and the actuation means may be a device to change the polarity of one of them, e.g. the central fixed element.

In the first configuration shown in FIG. 1*g*, the moveable member is in contact with the protruding element (15) and the wall defining the outer air channel, thereby blocking access to the outer air channel. Air is blown by the fan through the perforate section of the moveable member (17) into the inner air channel (8) and exits the hair dryer as warm air. The moveable member (17) is kept in this configuration by the magnetic polarity of the moveable member with respect to the fixed element (1404). Here, the moveable member and fixed element are of like polarity and therefore, magnetic repulsion forces the moveable member away from the fixed element and into contact with the protruding element.

In the second configuration of FIG. 1*h*, the "cool shot" button has been depressed and the actuation means activated. The actuation means changes the polarity of the fixed element to the opposite of the polarity of the moveable element. Magnetic attraction forces the moveable member (17) to come into contact with the fixed element (1404). The flange of the moveable member closes the annular gap between the central fixed element and the wall of the hot air channel and the perforate section is in contact with the central fixed element, thereby forming a solid impenetrable barrier to the inner channel. The movement also open the outer air channel. Air is now blown by the fan into the outer air channel and exits as a "cool shot" of air.

Reduction in Temperature Change Across the Air Stream

The stream of air produced by a hair dryer typically comprises hot spots and cool spots. For example, the stream of air may comprise a central cool spot. We describe below one way of minimising the temperature differential across the air flow of a hair dryer. This seeks to provide a hair dryer whereby the stream of air has a substantially constant temperature profile across the air flow.

The heating means for a hair dryer typically comprises multiple heating elements supported by a support means. The heating elements may be resistive heating elements such as, for example, resistor windings comprising resistive heating wire wound in the form of a coil.

Figure 2A:
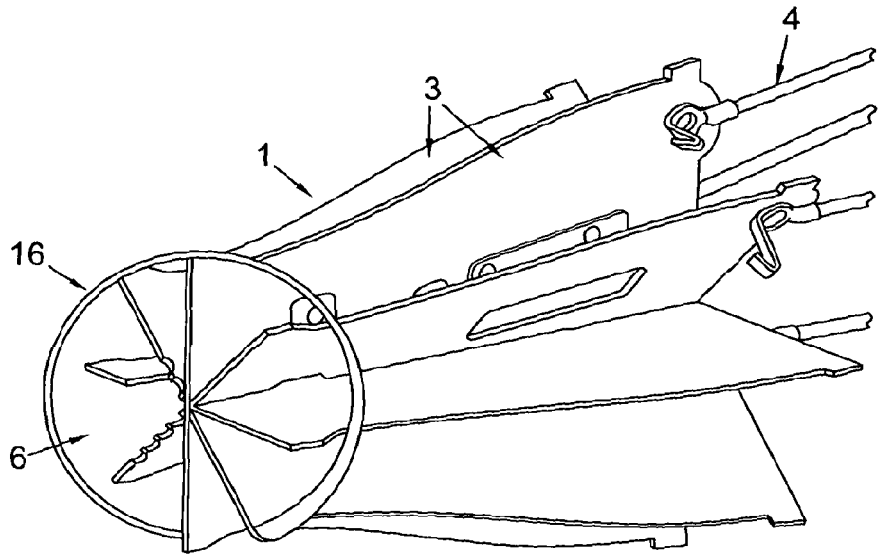
Fig.2a (Prior Art)
FIGS. 2*a* and 2*b* are perspective views of a known heating component which may be incorporated in the hairdryer of FIG. 1*a;*
Figure 2B:
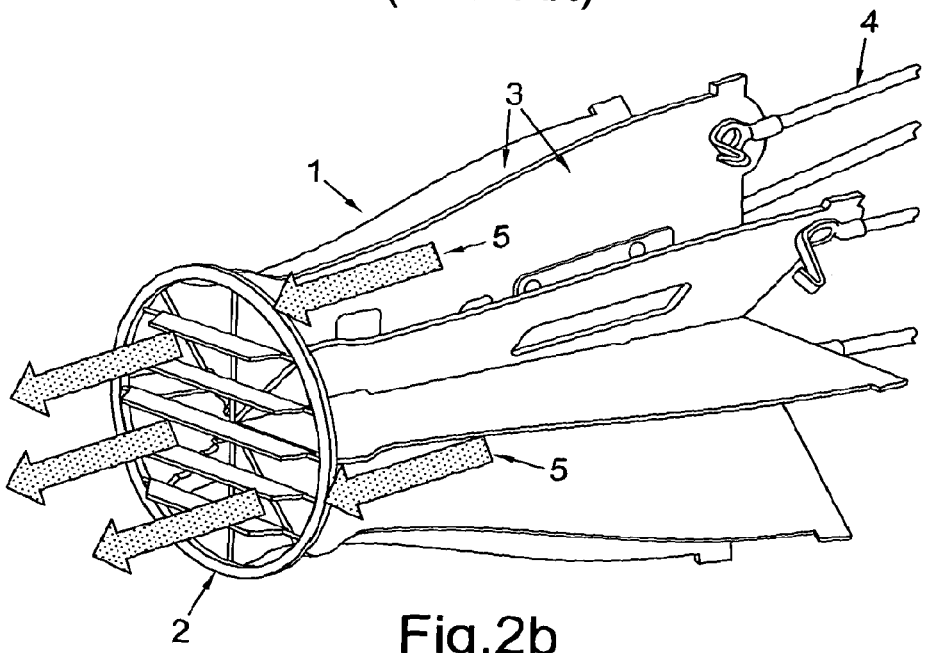
Fig.2b (Prior Art)

FIGS. 2*a* and 2*b* depict a perspective view of an example of a conventional support means (1) for a heating means. The support means is arranged at the rear of the heating elements (4) and adjacent the air outlet mesh (2) of the hair dryer. The support means comprises multiple support fins (3) whereby each support fin is configured to support a resistive heating element (4). The support fins extend radially from a central support in a star formation. Adjacent support fins define air flow channels (5) that separate the heated air into multiple air flow streams. Accordingly, the air flow exiting the conventional heating means, and thereby the air outlet, has a circumferential zone at a high temperature and a central zone at a lower (reduced) temperature.

We seek to address the central cool spot problem by providing a support means that is configured to combine (merge) the multiple air flow streams exiting the air flow channels. The combining of the multiple air streams flow mixes the heated air so as to form an air flow having a reduced temperature differential.

Figure 2C:
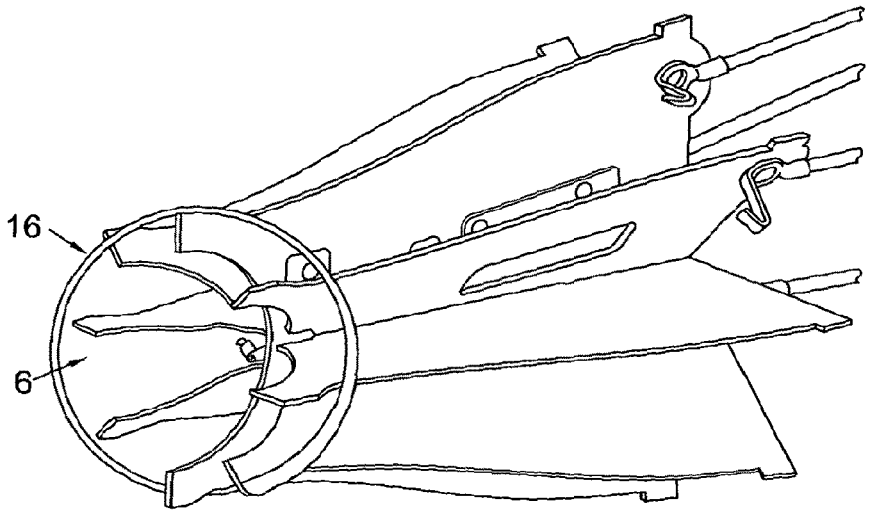
FIGS. 2*c* and 2*d* are perspective views of a variation of the known heating component which may be incorporated in the hairdryer of FIG. 1*a;*
Figure 2D:
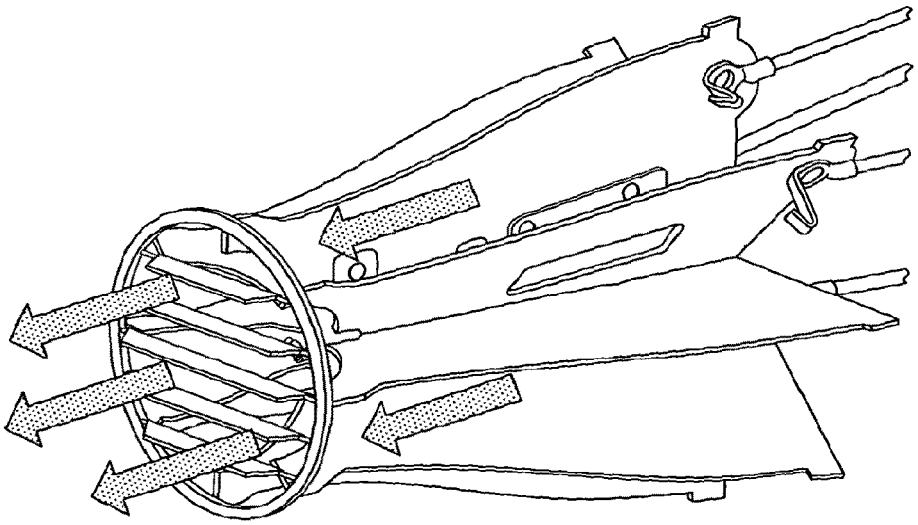

FIGS. 2*c* and 2*d* depict an example of a support means that is configured to combine the multiple air flow streams. The support means comprises a region (6) arranged at the rear of the heating element support where multiple air flows streams exiting the air flow channels combine to form an air flow stream having a substantially uniform temperature profile.

In this example, the fins are configured to define the region. The rear end portion of each fin (16) is configured to have an arcuate form so as to define a substantially semi-circular region. By removing the central end section of the heating element supports, the heated air can merge before passing through the outlet mesh. This leads to an improved mixture of heated air and results in a reduced temperature differential across the airflow.

Alternative arrangements in which the rear end portion of each fin are configured such that the multiple air flow streams are directed towards one another in the region may also be used.

Adjustment of Air Flow Volume

When a hair dryer is located close to a user's hair, e.g. when a hair stylist uses a hair dryer to force hot air into the hair fibres by placing the nozzle of the hair dryer against the fibres; air pressure builds up which restricts the flow of air from the hair dryer. The fan has to overcome this pressure. Conventional hair dryers run continuously at a defined speed regardless of the pressure applied by the user. This uses more energy, creates more noise and blows excessive air volume which can ruin a section of hair already styled (or blow other things around the room).

We describe a controller to provide automatic control of the air flow of the hair dryer.

The controller automatically controls the operation of the fan so as to at least substantially maintain a constant air flow volume during use. Therefore, the controller is able to automatically compensate for any changes in applied air pressure, for example as the hair dryer is moved with respect to a user's hair.

Preferably, the controller controls the rotational speed of the fan so as to at least substantially maintain a constant air flow volume. Accordingly, if an air pressure is applied, the controller automatically increases the rotational speed of the fan so as to at least substantially maintain a constant air flow volume. In other words, the solution is a fan motor which automatically adjusts to compensate for changes to system pressure to ensure that the air volume is kept constant giving the user more control.

Figure 3:
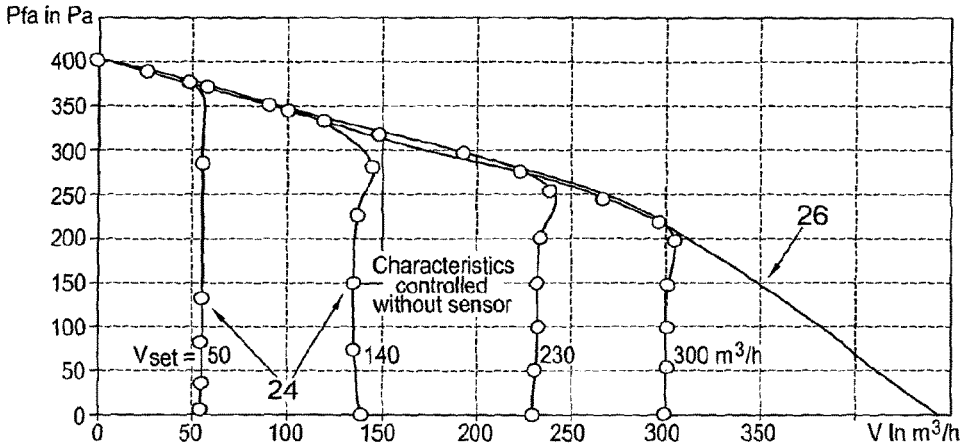
FIG. 3*a* is a graph of Pfa in Pa against volume in $m^3/h$ showing a typical constant volume curve and FIG. 3*b* illustrates a controller for controlling the fan speed.

As shown in FIGS. 3*a* and 3*b*, a hair dryer may comprise user control means 320 to manually select a particular air flow volume. If a hair dryer can be operated at one of several preset air flow volumes, the controller 321 may be configured to control the rotational speed of the fan motor 322 so as to at least substantially maintain the air flow volume at the desired preset level. Lines 24 show constant volumes of approx 50 and 140 respectively. The preset flow rates are achieved by increasing the rpm of the fan motor 322 to over-come the pressure applied. Line 26 shows the variation in pressure with volume, i.e. without constant volume.

The fan can determine its current duty point from its own motor speed and electrical current data. No external sensors or controls are required because the built in microprocessor's (55) algorithm calculates the fan speed needed to maintain the required air volume at any workload. If the duty point changes due to external influences, the fan compares the actual values against its preset values and adjusts the speed of the motor accordingly to ensure the same volume of airflow is maintained.

Cooling of Hair Dryer

During use, the housing of a hair dryer may become heated by the heating means and hot air stream. Indeed, the heating effect may be sufficient for the housing and nozzle to become too hot to touch. Most dryers currently on the market do not address this issue. There are some dryers which use methods of insulation with materials or air cavities to maintain a cool air temperature.

We describe cooling means to at least minimise the transfer of heat to the housing of the hair dryer. The cooling means may comprise an air flow channel along which ambient air (unheated air) may flow. This active cooling assisted by movement of ambient air is different to the passive insulation mentioned above.

The air flow channel may be configured to at least minimise the transfer of heat to at least a region of the main body of the hair dryer. The outer air flow channel may be alternatively or additionally configured to at least minimise the transfer of heat to the housing of a nozzle of the hair dryer.

Figure 4:
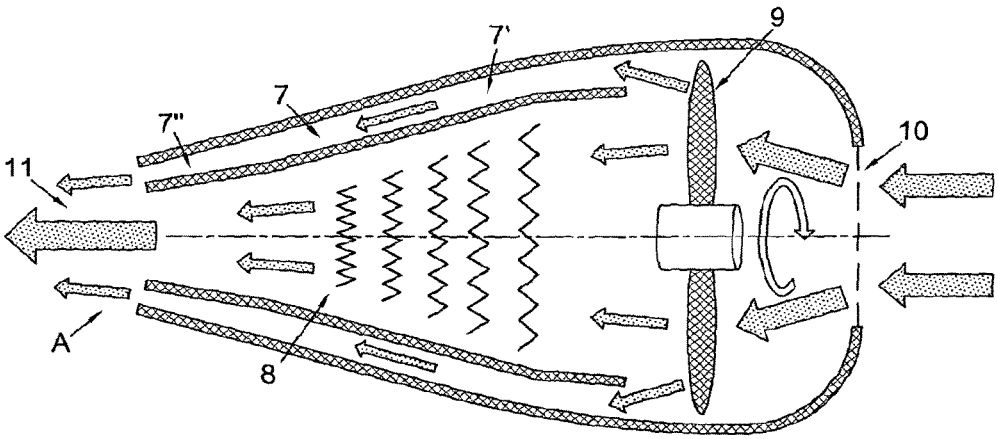
FIG. 4 is a cross-section of a hairdryer incorporating co-axial airflows.
Figure 5A:
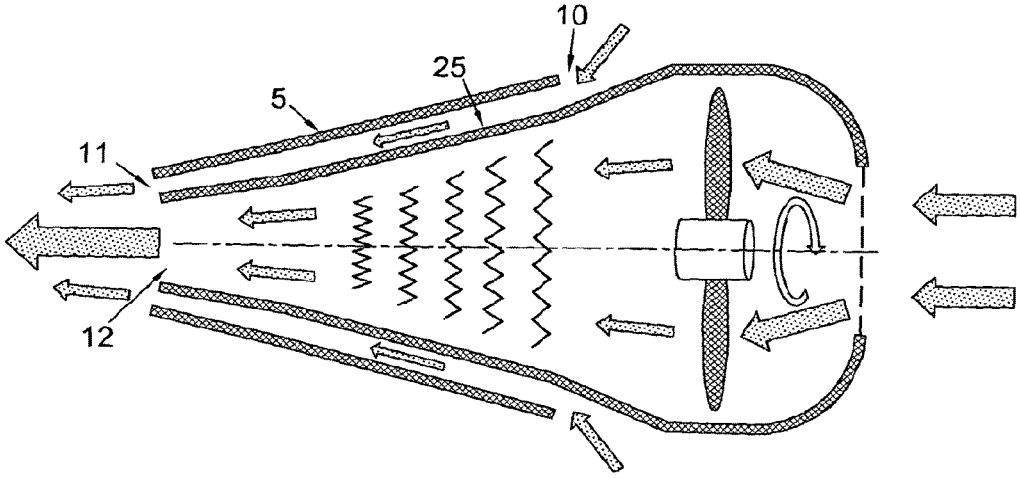
FIGS. 5*a* and 5*b* are cross-sections of a hairdryer incorporating a venturi effect airflow.
Figure 5B:
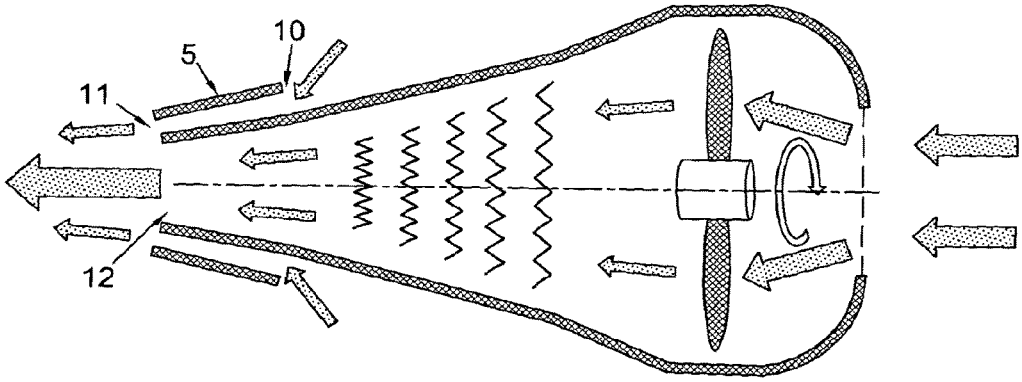

As depicted in FIGS. 4, 5*a* and 5*b*, the air flow channel may be an outer air flow channel (7) configured to at least substantially circumscribe an inner air flow channel (8).

In the hair dryer depicted in FIG. 4, the hair dryer comprises a housing defining an outer air flow channel (7) having ducts (7') in the housing and ducts (7") in the nozzle, an inner air flow channel (8), an air inlet (10) and an air outlet (11). The outer air flow channel and inner air flow channel are configured such that a fan (9) located in the housing can drive air along both air flow channels from the air inlet to the air outlet (11). The air flow along the inner air flow channel is heated by heating means so as to provide a hot stream of air. The air flow along the outer air flow channel acts as an insulator and thereby minimises the transfer of heat from the heating means and hot stream of air to the outer housing wall. Arrow A indicates the portion of the air that bypasses the heater element. The hairdryer is thus a co-axial airflow design. The airflow channelled from the fan down the outer air flow channel provides active cooling of the housing and nozzle.

As shown in FIGS. 5*a* and 5*b*, the air flow channel (5) may be a venturi tube configuration whereby the diameter of the air flow channel varies so as to reduce air pressure along the length of the channel. The high pressure fast moving air exiting the nozzle (12) creates a pressure drop. Accordingly, this venturi effect drives ambient air along the flow channel from an air inlet (10) to the air outlet (11) so as to provide a cooling effect on the outer housing wall (25) and the nozzle (12). The air flow channel (5) may extend along at least a substantial part of the housing as shown in FIG. 5*a* or may just extend along the nozzle as shown in FIG. 5*b*.

So as to maximise the cooling effect, the air flow channel having a venturi tube configuration may comprise a secondary air inlet so as to allow the fan of the hair dryer to drive further ambient air along the air flow channel.

Combined Heating and Flow Control

A hair dryer typically comprises an air flow stator to generate a smooth flow of air. The smooth flow of air is a substantially straight flow of air.

We describe a hair dryer whereby an air flow stator and heating means are located in substantially the same location in a housing of the hair dryer.

This arrangement minimises the overall size of the hair dryer. The arrangement reduces the resonating regions within housing of the hair dryer and thereby minimises the noise of the hair dryer. The arrangement also helps to maximise the differential temperature ΔT between the air outlet and air inlet of the hair dryer within the smallest volume possible.

Figure 6:
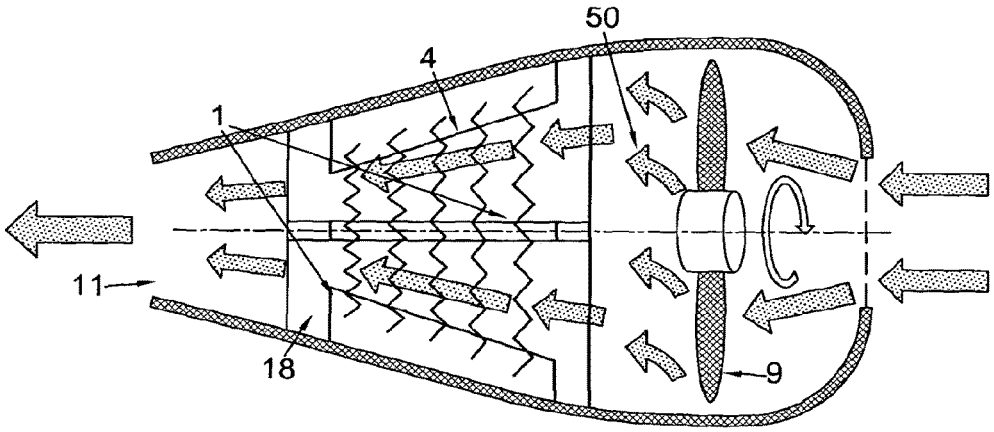
FIGS. 6 and 7 are cross-sections of a hairdryer incorporating integrated heated flow control.
Figure 7:
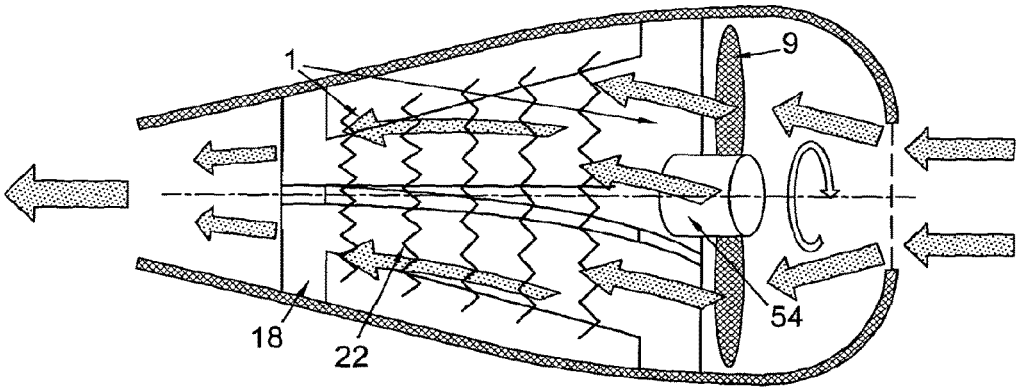

FIGS. 6 and 7 depict an example of a hair dryer where the air flow stator (18) and heating means (4) are located in substantially the same location between the fan (9) and air outlet (11).

The air flow stator and heating means may be integrally formed. For example, the heating means may comprise resistive heating tracks printed on an inner surface of the stator. It is desirable to have a substantially uniform temperature profile across the air flow. Accordingly, the inner surface of the stator may have a toothed configuration so as to help provide a substantially uniform heating effect across the flow of air.

The air flow stator and heating means may be integrally formed as shown FIGS. 6 and 7 whereby the heating means comprise resistive heating elements (22) supported by support means (1) and the support means is configured to function as the stator. This ensures that swirl is removed from the airflow and that the airflow is heated in a more efficient way. The integrated component may be made from a ceramic and/or high temperature material.

As shown in FIG. 6, fan is spaced away from the support means. Thus air leaving the fan (50) swirls and is straightened by the stator (18). The stator (18) is formed support means (1) which are straight and three-dimensional. These support means (1) are thus air straightening blades which remove the swirl from the air flow. In FIG. 7, the motor (54) is mounted on and within the heater support means (1).

Alternatively, the heating means may be supported by supporting means provided at substantially the same location as the stator, whereby the heating means and supporting means are configured so as not to impart any rotational movement to the air flow.

Acoustic Attenuation

Figure 8:
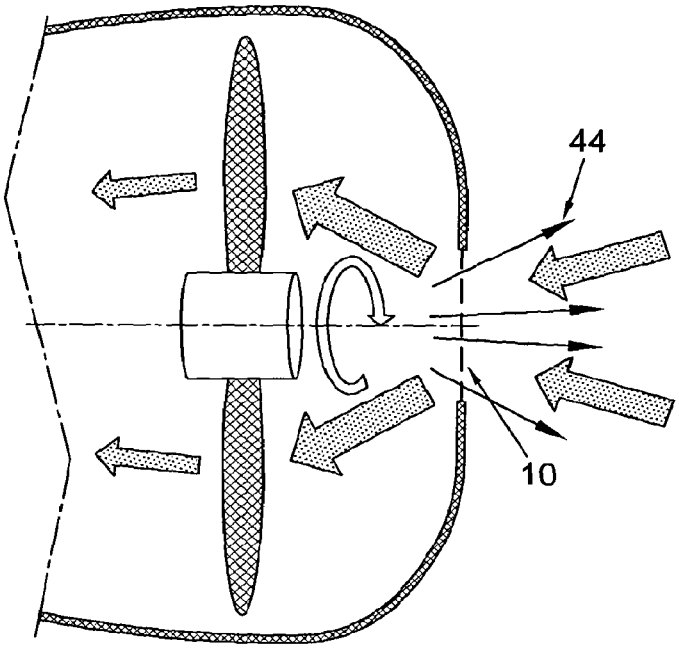
Fig.8 (Prior Art)
FIG. 8 is a cross-section of one end of a known hairdryer.

FIG. 8 depicts an example of a conventional hair dryer whereby the air inlet (10) is configured to allow for air to be drawn into the housing and for noise (44) to be emitted from the housing. Such a product has a direct sound path to the motor and fan. Thus, motor and aerodynamic noise is released.

We described a hair dryer comprising an air inlet system that is configured to attenuate noise generated by the hair dryer.

As shown in FIGS. 9*a* to 9*d*, the hair dryer may comprise a housing having a rear wall (23) with a first air inlet (10) and a baffle member (27) spaced from the rear wall so as to define a second air inlet (28) between the baffle member and the rear wall. The normal air path (43) is thus blocked by the baffle member and is redirected. This may be considered an acoustic labyrinth.

In use, air is drawn into the hair dryer through the second air inlet and then the first air inlet. The first air inlet (10) may be covered by a protective mesh (42).

The baffle may be releasably coupled (see FIG. 9*c*) or integrally formed with the housing of the hair dryer. The baffle may be releasably coupled using releasable coupling means such as clipping means or magnetic means.

The baffle member is generally planar and is arranged to extend at least substantially perpendicular to the longitudinal axis of the housing. Hence, air enters the second air inlet at an angle to the longitudinal axis of the housing. The air is preferably drawn into the second air inlet at an angle of 90 degrees with respect to the longitudinal axis of the housing.

Figure 9A:
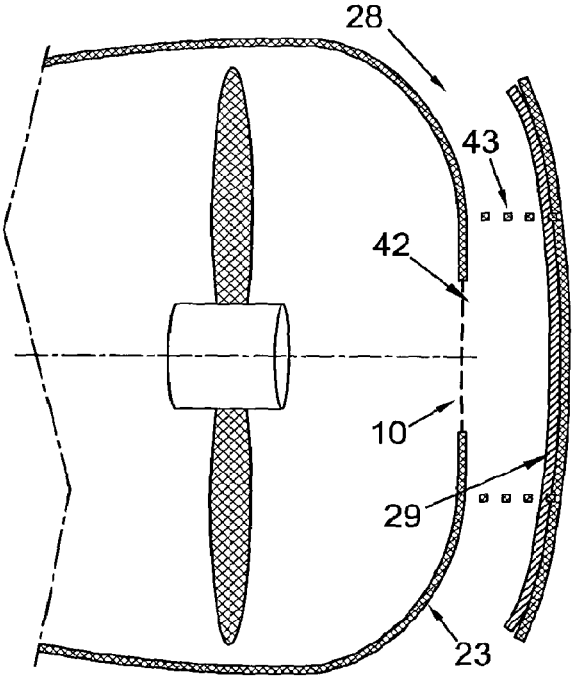
FIGS. 9*a* to 9*d* are cross-sections showing baffling of the hairdryer of FIG. 8.
Figure 9B:
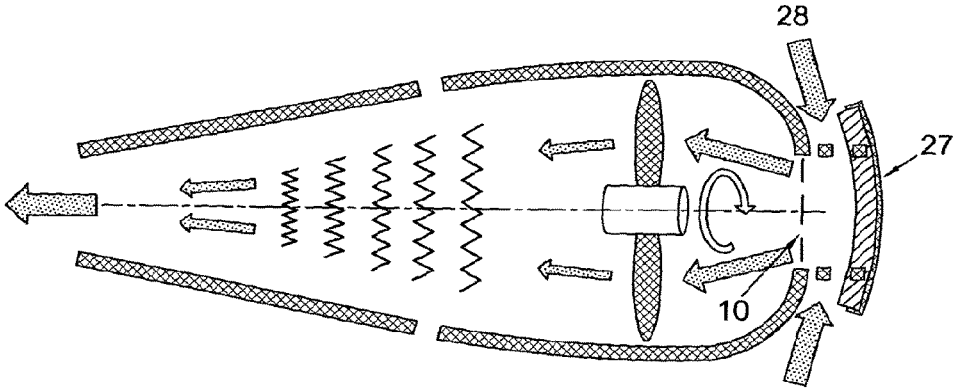
Figure 9C:
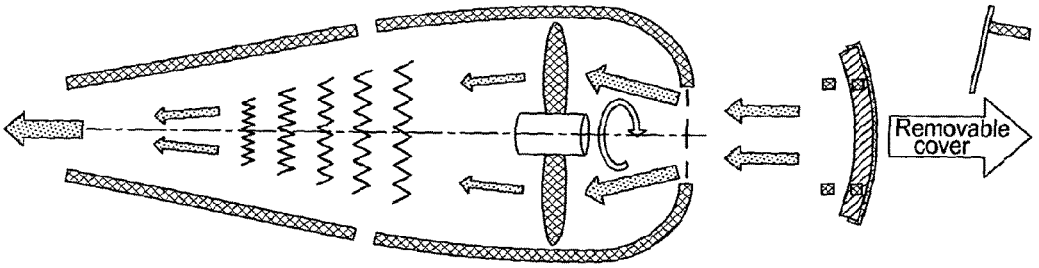
Figure 9D:
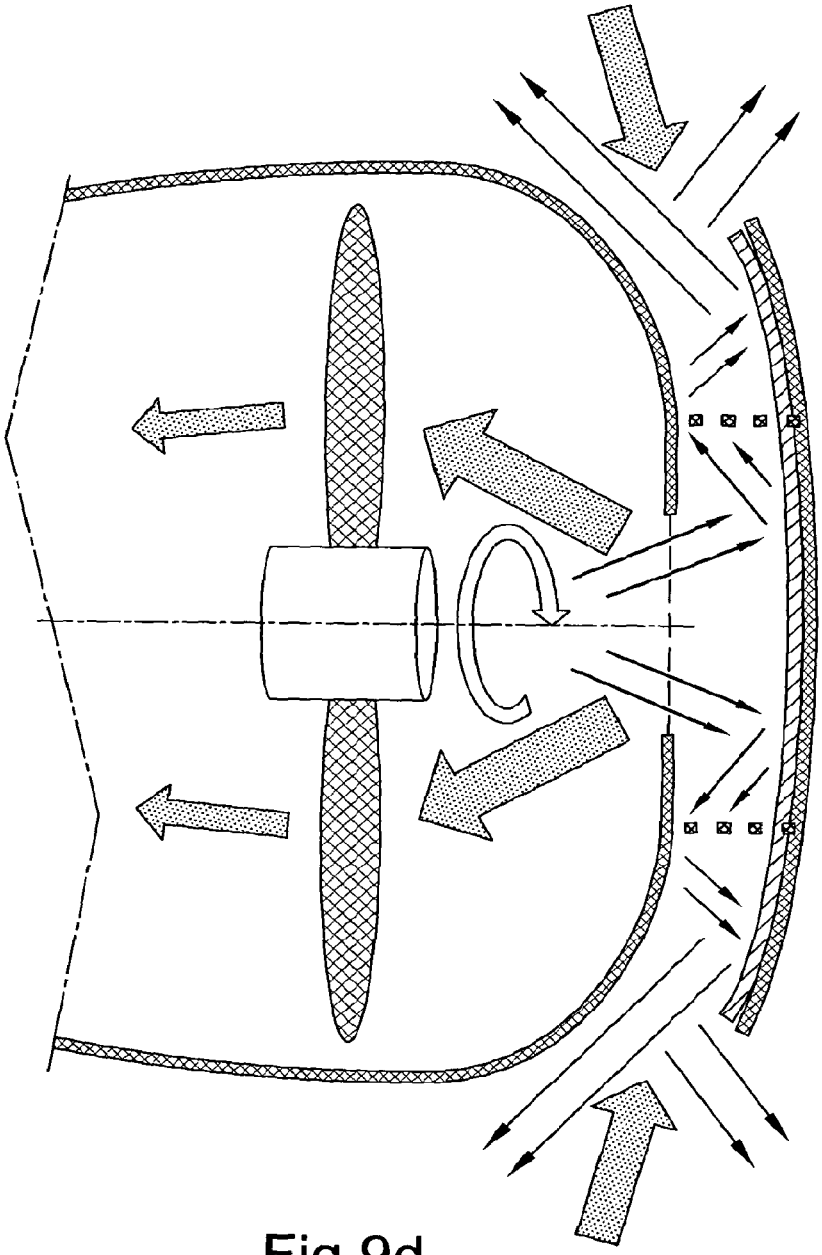

The arrangement of the baffle helps to attenuate noise emitted by the hair dryer. As shown in FIG. 9*d*, the baffle is arranged such that noise emitted via the first air inlet is reflected between the baffle member and rear wall, and thereby looses energy, before reaching the second air inlet.

So as to maximise the attenuation of noise, the baffle member may comprise an acoustic absorbing material so as to absorb noise emitted from first air inlet. For example, the baffle member may comprise a layer of acoustic absorbing material (29) arranged on an inner surface of the baffle member as shown in FIGS. 9*a* to 9*d*. Thus, in the configured of FIG. 9*d*, noise is absorbed through reflection into the absorbent material and released over a larger air inlet area.

The hair dryer may comprise one or more baffle members. For example, the hair dryer may comprise multiple baffle members arranged in a stepped formation at the rear of the housing.

Through out the description and claims of this specification, the words "comprise" and "contain" and variations of the words, for example "comprising" and "comprise", means "including but not limited to, and is not intended to (and does not) exclude other moieties, additives, components, integers or steps.

Throughout the description and claims, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example, of the invention are to be understood to be applicable to any other aspect, embodiment or example described herein unless incompatible therewith.

The invention claimed is:

1. A hair dryer comprising:

a housing having an air inlet and an air outlet, the housing defining a first air flow channel and a second air flow channel between the air inlet and the air outlet, wherein the first air flow channel circumscribes the second air flow channel;

an air flow regulator that regulates flow of air along the first air flow channel and the second air flow channel;

a fan having a built-in microprocessor, the fan for drawing air through the air inlet and for blowing air through the first and second air flow channels to the air outlet; and a heater located within the second air flow channel for heating air drawn in through the air inlet that passes through the second air flow channel to the air outlet;

wherein the microprocessor is operative to:

determine a current duty point based on a motor speed and electrical current draw, calculate an operating speed of the fan needed to maintain a preset air flow volume from the air outlet; and adjust the motor speed to maintain the operating speed of the fan so as to maintain the preset air flow volume from the air outlet.

2. The hair dryer according to claim 1, wherein the first air flow channel is defined between an inner surface of the housing and an outer surface of the second air flow channel.

3. The hair dryer according to claim 1, wherein the air flow regulator is configured to instantaneously redirect flow of air from the second air flow channel to the first air flow channel whereby a cold shot of air is provided.

4. The hair dryer according to claim 1, wherein the air flow regulator comprises a member movable between a first position and a second position, wherein in the first position the member is arranged to close an inlet aperture of the first air flow channel and in the second position the member is arranged to at least minimise an inlet aperture of the second air flow channel.

5. The hair dryer according to claim 4, wherein the moveable member is activated by user operated control means.

6. The hair dryer according to claim 4, wherein the air flow regulator comprises a moveable member connected to an actuator wherein movement of said actuator moves said moveable member.

7. The hair dryer according to claim 6, wherein the actuator slides along a shaft connected to a motor which draws air into the hair dryer.

8. The hair dryer according to claim 4, wherein in the first position the moveable member tapers downstream and in the second position the moveable member tapers upstream.

9. The hair dryer according to claim 4, wherein the air flow regulator further comprises at least one fixed element which co-operates with the moveable member to close at least one of said first and said second air flow channels.

10. The hair dryer according to claim 9, wherein the at least one fixed element comprises an outer fixed element which protrudes from an outer surface of the housing and co-operates with the moveable member to close said first air flow channel in said first position.

11. The hair dryer according to claim 9, wherein the at least one fixed element comprises a central fixed element which is concentrically mounted within the housing and which co-operates with the moveable member to close said second air flow channel in said second position.

12. The hair dryer according to claim 11, wherein the moveable member and the central fixed element are in a form of perforated plates each having offset perforations whereby when the moveable member and the central fixed element are in contact, the second air flow channel is closed.

13. The hair dryer according to claim 9, wherein the moveable member and at least one fixed member are made from a ferro-magnetic material and the regulator comprises an actuator configured to change a polarity of at least one of said moveable member and said at least one fixed member to move said moveable member relative to said at least one fixed member.

14. The hair dryer according to claim 1 wherein the first air flow channel is configured to form a venturi effect for driving air along the first air flow channel from a second air inlet to said air outlet; and wherein the hair dryer further comprises a heater for heating air flow in the second air flow channel.

15. The hair dryer according to claim 1 comprising multiple heating elements supported by a support; wherein the support comprises a front region where air is separated into multiple air flow streams and a rear region configured to combine the multiple air flow streams so as to form an air flow stream having a uniform temperature profile.

16. The hair dryer according to claim 15, wherein the support comprises multiple fins, each fin having a front portion and a rear portion and configured such that the front portion of the fins define multiple air flow channels and the rear portions of the fins define the rear region.

17. The hair dryer according to claim 1, wherein the hair dryer is operable at one of several pre-selected air flow volumes and the microprocessor is configured to automatically control the rotational speed of the fan so as to maintain the pre-selected air flow volume.

18. The hair dryer according to claim 1 comprising:

a rear wall having a first rear air inlet;

a baffle member spaced from the rear wall so as to define a second rear air inlet between the baffle member and the rear wall;

wherein, in use, air is drawn into the hair dryer through the second rear air inlet and first rear air inlet.

19. The hair dryer according to claim 18, wherein the baffle member is generally planar and located perpendicular to a longitudinal axis of the hair dryer such that air enters the second air inlet at an angle to the longitudinal axis.

20. The hair dryer according to claim 18, wherein the baffle member comprises acoustic absorbing material.

* * * * *